United States Patent [19]

Ohsaka et al.

[11] 4,149,652

[45] Apr. 17, 1979

[54] MEMBRANE STRUCTURE IN A LIQUIFIED GAS STORAGE TANK

[75] Inventors: Kenji Ohsaka, Tokyo; Koichi Hagiwara, Nagasaki; Toshikazu Niwa, Yokosuka; Shunsuke Yamagata, Fujisawa, all of Japan

[73] Assignee: Mitsubishi Jukogyo Kabushiki Kaisha, Tokyo, Japan

[21] Appl. No.: 893,310

[22] Filed: Apr. 4, 1978

[30] Foreign Application Priority Data

Aug. 15, 1977 [JP] Japan ..... 52-97626
Aug. 23, 1977 [JP] Japan ..... 52-100847

[51] Int. Cl.[2] ..... B65D 25/16; E04B 1/98

[52] U.S. Cl. ..... 220/440; 52/573; 220/901

[58] Field of Search ..... 52/573; 220/435, 436, 220/440, 442, 901

[56] References Cited

U.S. PATENT DOCUMENTS

| | | | |
|---|---|---|---|
| 2,736,400 | 2/1956 | Gay et al. | 52/573 X |
| 3,184,094 | 5/1965 | French et al. | 220/440 |
| 3,299,598 | 1/1967 | Alleaume | 52/573 X |
| 3,310,925 | 3/1967 | Le Brun | 52/573 |
| 3,395,438 | 8/1968 | Seeff | 52/573 X |
| 3,406,858 | 10/1968 | Jackson | 220/440 |
| 3,486,286 | 12/1969 | Samaga | 52/573 X |
| 3,510,278 | 5/1970 | Alleaume | 220/442 X |
| 3,994,693 | 11/1976 | Parmley | 52/573 X |

FOREIGN PATENT DOCUMENTS

| | | | |
|---|---|---|---|
| 6515324 | 5/1966 | Netherlands | 52/573 |
| 1041507 | 9/1966 | United Kingdom | 52/573 |

*Primary Examiner*—William Price
*Assistant Examiner*—Allan N. Shoap
*Attorney, Agent, or Firm*—Wenderoth, Lind & Ponack

[57] ABSTRACT

The present invention provides a membrane structure for a liquid gas storage tank. The structure is characterized in that the bottom wall of the membrane comprises a number of elongated corrugated members arranged in a square-lattice pattern, and each member has a pair of spaced, parallel, longitudinally extending corrugations. Also, the members are assembled by joining one end of each corrugated member to substantially the mid-point of another corrugated member extending normal thereto, and each opening between the corrugated members is closed and made liquid tight by a thin plate.

Preferably, each corrugated member is a sheet member of U-shaped cross-section, having a pair of vertical flanges of equal height, located between a pair of sheet members of L-shaped cross-section which are arranged back to back in spaced, parallel relationship, the top edges of respective adjacent vertical flanges of said L-shaped and said U-shaped members being continuously welded together.

3 Claims, 8 Drawing Figures

MEMBRANE STRUCTURE IN A LIQUIFIED GAS STORAGE TANK

BACKGROUND OF THE INVENTION

This invention relates to membrane structures for storage tanks for low-temperature liquified gases of the kind comprising side and bottom walls incorporating corrugated expansion joints.

Heretofore, various constructions for the membrane structure have been made employing corrugations for the purpose of absorbing strains caused by thermal movements. Among these is a membrane wall construction in which corrugated members are assembled in a square-lattice pattern to form a framework, and each of the square openings defined by this framework is closed and made liquid-tight by use of a thin plate. Normally, central portions of the thin plates, or central portions of the corrugated members are anchored to support walls by means of bolts, rivets, etc. However, prior art structures constructed as described above have the following disadvantages:

(1) Since the corrugated members or thin plate members are anchored, when a liquid to be stored is poured into the tank, upon thermal contraction of only a part of the bottom wall, the entire bottom wall or the broad sweep of its section cannot follow the contraction. Thus, deformation of the corrugations locally becomes large and can result in permanent deformation of the corrugations; in cases where the thermal strain cannot be absorbed by only the corrugations of that part of the bottom wall which is subjected to thermal contraction, the corrugations may be damaged.

(2) Since anchoring is generally made at a large number of points, the increase in the cost of construction is inevitable.

(3) An accidental leakage of the stored liquid through an anchoring point is also liable to occur.

Low-temperature storage tanks are generally made cylindrical in shape in order to economise in the use of materials and to withstand the pressure. Accordingly the bottom wall is circular in shape. In addition, since the inside of the cylindrical tank is exposed to an ultra-low temperature, a membrane structure having corrugations is often used for the inner side and bottom walls for the purpose of absorbing thermal strains.

In view of the aforementioned circumstance, tanks of the prior art have disadvantages in that matching the corrugations between a side wall and the bottom wall, is difficult, and if the bottom wall which is placed under the influence of the most severe thermal strain, is to be formed in such a way that the strain can be fully absorbed, then it is difficult to construct the junction in the vicinity of the boundary of the bottom wall where it is joined with the side wall. This inevitably results in a membrane structure in which strain concentration is liable to occur in the vicinity of that boundary. In such a case, there could arise a complex structurally strained state in the joint portion between the bottom and side walls.

SUMMARY OF THE INVENTION

It is an object of the present invention to provide a membrane structure for a liquefied gas storage tank, in which neither corrugated members nor thin plate members forming a bottom wall are anchored, and provision is made so that even if local thermal contraction should arise in a part of a tank wall resulting in the corrugations in that part of the wall being unable to fully absorb the thermal strain, the other parts may be drawn toward the part of the local thermal contraction with appropriately distributed strains, whereby neither permanent deformation nor damage to the corrugations will occur.

Another object of the present invention is to provide a membrane structure for a liquefied gas storage tank, in which the labour of installing the tank is greatly reduced compared with prior art structures and the danger of leakage of stored liquid through anchoring points is totally eliminated.

Still another object of the present invention is to provide a membrane structure, in which the disadvantages of the prior art structures caused by the thermal deformation of a bottom wall are substantially eliminated, and to in which the bottom wall is connected to a side wall using a new method, whereby stress concentration can be obviated and accidental leakage of stored liquid can be substantially prevented.

According to this invention a membrane structure for a liquified gas storage tank of the kind having side and bottom walls incorporating corrugated expansion joints, is characterized in that the bottom wall of the membrane comprises a number of elongated corrugated members arranged in a square-lattice pattern, in that each member has a pair of spaced, parallel, longitudinally extending corrugations, and the members are assembled by joining one end of each such corrugated member to a substantially mid-point of another corrugated member extending normal thereto, and in that each opening provided between the corrugated members is closed and made liquid tight by a thin plate.

In one application of the present invention the bottom wall of the membrane structure is constructed in the following manner:

Each elongated corrugated member may comprise a sheet member of U-shaped cross-section, having a pair of vertical flanges of equal height, located between a pair of sheet members of L-shaped cross-section which are arranged back to back in a spaced, parallel relationship, the top edges of respective adjacent vertical flanges of the L-shaped and the U-shaped members being continuously welded together.

With a bottom wall constructed in accordance with the invention, when it is subjected to low temperatures and contracts, because one end of each corrugated member is joined to the mid-point of another corrugated member extending normal thereto, the corrugated members can open out like a concertina relatively to each other, and each thin plate closing the square openings of the lattice framework can thus contract uniformly while maintaining its natural strainless state. Thereby, the thermal strain can be absorbed by each framework unit without plastic deformation.

In addition, since anchoring is not employed, the thermal strains can be distributed uniformly over the entire bottom wall. Also, the labour of installation can be greatly reduced, and there is no danger of stored liquid leaking from the anchoring points.

Furthermore, in the particular bottom wall structure described, since the top edges of the adjacent flanges of the L-shaped and U-shaped members are continuously welded, the welding bead increases the second moment of area in the transverse plane of the corrugated member, thus resulting in a substantial increase in resistance to buckling of the bottom wall upon thermal expansion.

Still further, a membrane structure in accordance with the present invention may have the following construction.

The membrane side wall provides a plurality of spaced corrugations extending in the vertical direction, and corner members are provided having corrugations therein which are arranged to continue the corrugations of the said side wall over a peripheral portion of the bottom wall of the membrane radially toward the centre of the bottom wall.

According to the above-described construction, a membrane structure can be constructed in which stress concentration will not occur and accidental leakage of stored liquid can be substantially prevented, because the bottom wall can efficiently absorb thermal strain in a manner as described above, and because the corner members which form the joint between the side wall and the bottom wall continue the vertical corrugations of the side wall into the periphery of the bottom wall.

BRIEF DESCRIPTION OF THE DRAWINGS

One preferred embodiment of a cylindrical storage tank for liquified gas having a membrane structure in accordance with the present invention, will now be described in greater detail with reference to the accompanying drawings, in which.

DETAILED DESCRIPTION OF THE INVENTION

Figure 1:
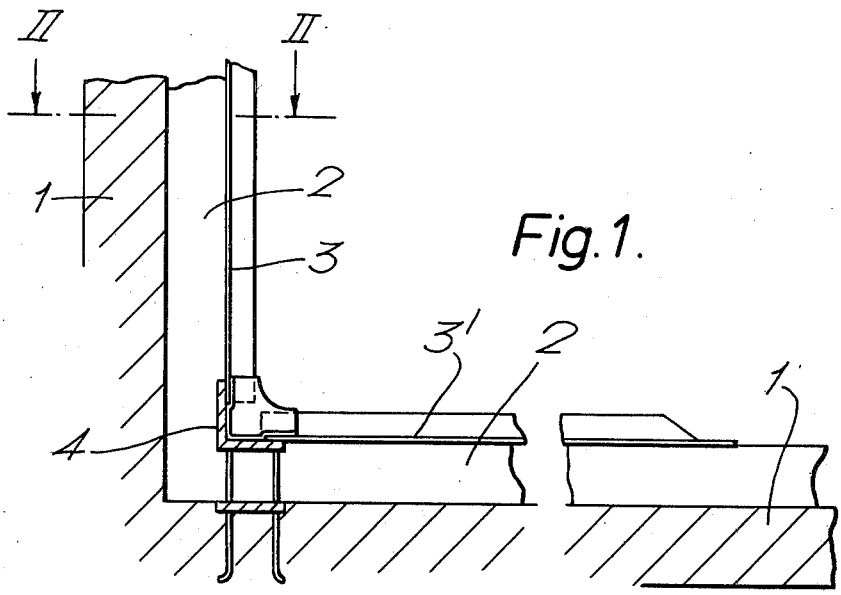
FIG. 1 is a partial side view in cross-section in the vicinity of a bottom corner of the tank.

Referring to FIGS. 1 to 4, a cylindrical concrete outer shell 1 forms rigid side and bottom walls for the tank and has one or more layers of a heat-insulating material 2 applied to its inner surface for the purpose of maintaining a low temperature. A membrane side wall structure 3 is located against the inner surface of the heat insulating layer and is provided at spaced intervals around its circumference with vertically extending corrugations 5, which provide expansion joints. Flanged radial gusset members 3' are connected to the bottom of the membrane side wall 3 to form a junction between the side wall 3 and the periphery of a membrane bottom plate 13, which consists of corrugated members 7 and thin plates 11 as will be described later. To provide a support for the bottom of the membrane wall 3 and the outer periphery of the membrane bottom plate 13, metal support brackets 4 are provided which are rigidly held in position by support bars extending into the bottom wall of the concrete shell 1. The brackets 4 support corner members 6 which connect the membrane side wall 3 and membrane bottom plate 13 and, in particular, provide corrugations 6' which continue the vertical corrugations 5 of the side wall 3 and corresponding upstanding corrugations 5' of the bottom plate 13 as will be described later. As mentioned above the bottom plate 13 comprises a multiplicity of corrugated members 7, each of which consists of two L-shaped elongated members 8 and a U-shaped elongated member 9. These corrugated members are arranged in sets of four and are normal to each other to form a square framework; one end of each corrugated member is joined in an overlapping relationship to a substantially the mid-point in the lengthwise direction of an adjacent corrugated member (such an arrangement is shown in detail in FIGS. 5 to 8).

Figure 6:
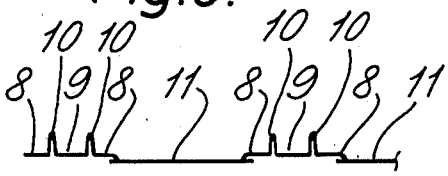
FIG. 6 is a cross-sectional view taken along a line VI—VI in FIG. 5.

As shown particularly in FIG. 6, to assemble the members 8, 9 of each corrugated member 7, the two L-shaped sheet members 8 are placed in a back-to-back spaced and parallel relationship and the U-shaped sheet member 9 is interposed therebetween so that the vertical flanges of the members abut each other; the adjacent vertical flanges are then welded together along their top edges 10 in the lengthwise direction to form upstanding corrugations. A thin plate 11 is welded around its periphery to close and make liquid-tight each square central opening of the framework formed by the corrugated members 7.

Figure 4:
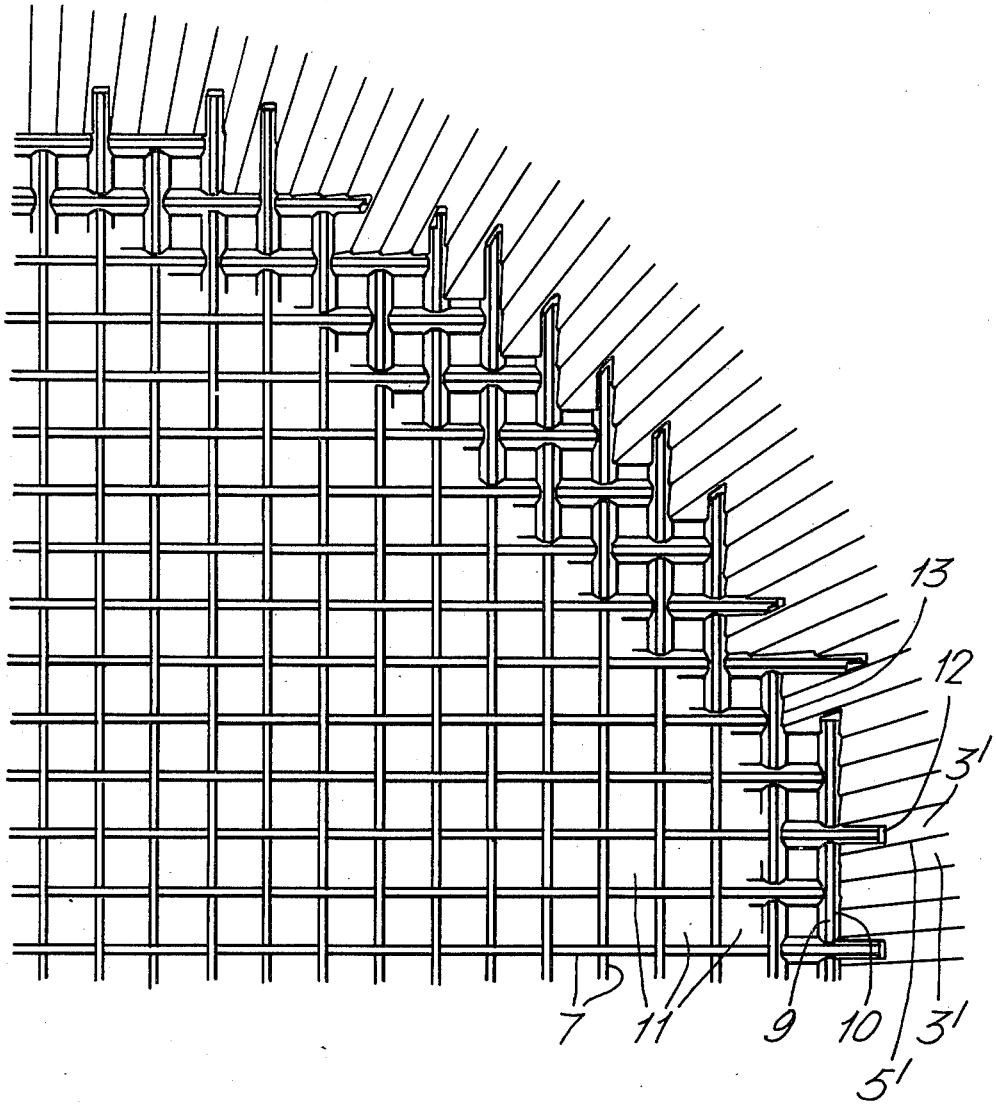
FIG. 4 is a plan view of one quadrant of the tank bottom shown in FIG. 1.

It is to be noted that the overlapped joint portions of the corrugated members 7 are made liquid-tight by welding. When the bottom plate membrane structure constructed in the above-described manner is applied over the insulation layer 2 at the bottom of the cylindrical shell 1, in the vicinity of the boundary between the membrane side wall 3, the membrane structure is either trimmed to a circular shape or lap-welded to an edge plate having appropriate corrugations. In this way, the corrugated members 7 and the thin plates 11 jointly form a bottom membrane wall having a square-lattice pattern as shown in FIG. 4.

Reference 12 designates a patch for joining each end of each outermost corrugated member 7 onto the periphery of the bottom plate 13 which forms a principal part of the bottom surface of the tank, via a radial gusset member 3'. The bottom plate 13 consists of a succession of assemblies of corrugated members 7 and thin plates 11 formed into the square-lattice pattern.

Figure 5:
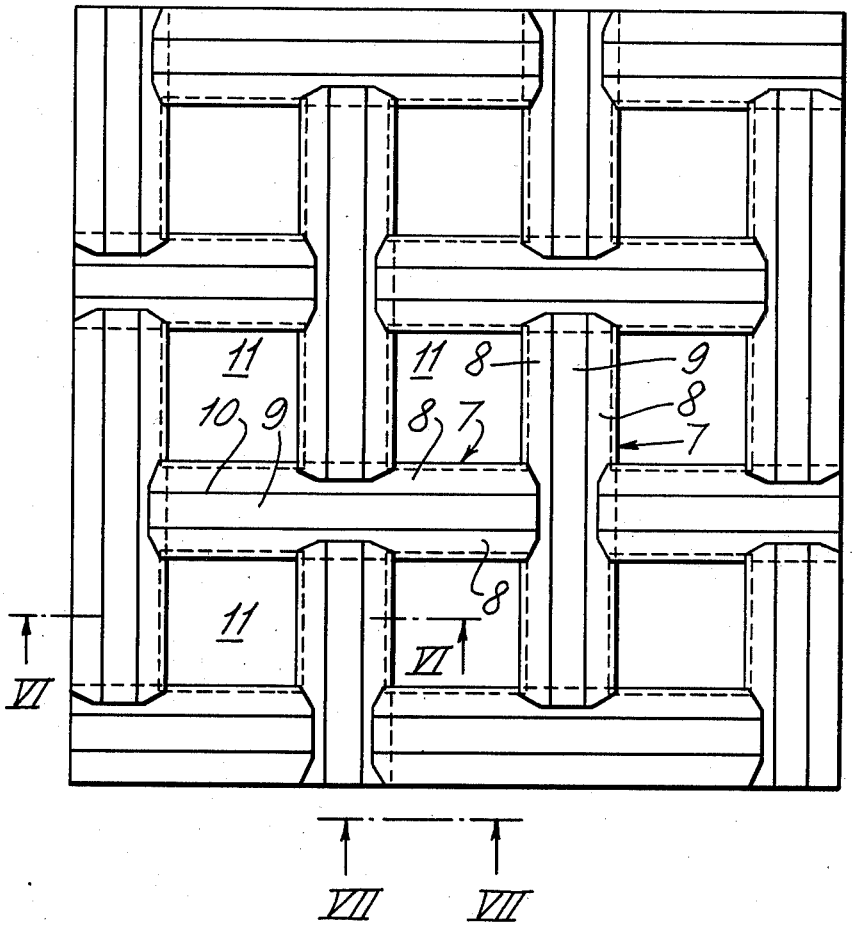
FIG. 5 is an enlarged partial view of FIG. 4.
Figure 7:
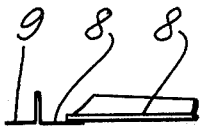
FIG. 7 is a side view in the direction of the arrows VII—VII in FIG. 5.

The absorption of the thermal strain by the bottom plate 13 formed by assembling the corrugated members 7 and the thin plates 11, as shown in FIGS. 5 to 7, will now be explained in greater detail with reference to FIG. 8.

Considering now the case where the corrugated members 7 and the thin plates 11 (FIG. 5) make contact with a stored liquid and as a result are subjected to very low temperature and contract, at first, with regard to a thin plate 11, since its periphery which is welded to the flanges of its surrounding corrugated members 7 is drawn towards its centre, the adjacent corrugations of the surrounding corrugated members will have their lower portions opened, like a concertina, so as to adapt themselves to the contraction of the thin plate 11. The plate will thus contract without being subjected to large reaction forces; thermal stresses will therefore not occur.

Figure 8:
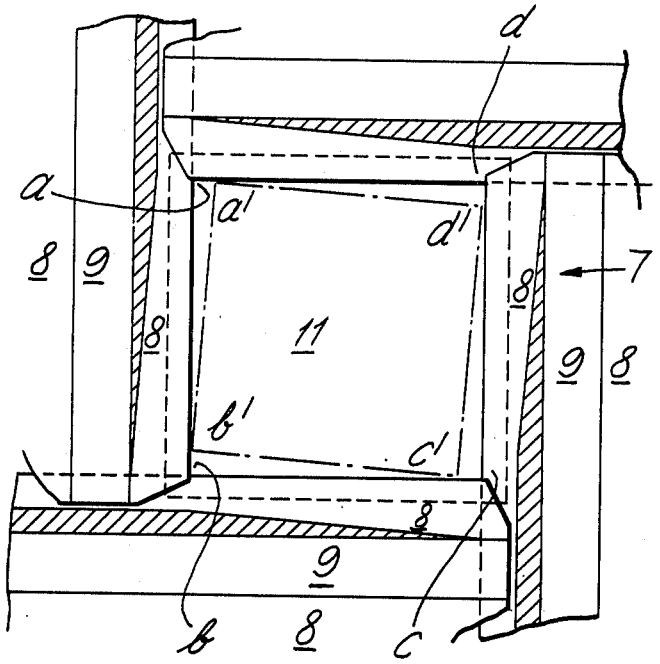
FIG. 8 is a diagrammatic view for illustrating thermal strains on the bottom surface shown in FIG. 5.

A diagrammatic representation of this contracted state is shown in FIG. 8, in which, while the mid-point of each corrugated member 7 can be fully opened, by being drawn laterally by contraction of the respective corrugated member 7 attached thereto, the end portions of each corrugated member 7 are fixedly secured to other, crossing corrugated members 7. Therefore, the degree of opening of each corrugated member is gradually decreased from its mid-point towards its ends, where the degree of opening is reduced to zero. The degree of opening is diagrammatically represented by hatched portions in FIG. 8. Since these openings arise uniformly along the four edges of the thin plates 11, each thin plate 11 is displaced from its original four-corner positions a . . . d to four new corner positions a' . . . d', and consequently, during contraction movement, each plate 11 is rotated through a small angle.

Such a deformation and displacement will occur at the respective locations, so that when the bottom wall is uniformly subjected to low temperature and contracts, the thermal strains can be absorbed at the respective locations, whereby harmful thermal stresses will not arise at any location. Thus, the membrane structure can be protected from damage or permanent deformation.

Now the effects and advantages of the complete tank as described above will be explained.

Firstly, it is to be noted that since the tank is manufactured generally at room-temperature conditions significant thermal strains occur when a liquid at a super-low temperature is poured into the tank, resulting in contraction of its inner wall.

Accordingly, when subjected to a low temperature the side wall 3 will contract in its longitudinal direction and, since nothing can specifically constrain such longitudinal contraction, a thermal stress cannot arise. With regard to contraction in the circumferential direction, some inconsistency is liable to occur because the rates of contraction per unit of time of the bottom plate 13, which is of substantially plane shape, and the side wall of cylindrical shape are generally not the same. However, according to the present invention, this inconsistency can be eliminated by the opening of the vertical corrugations 5.

Next, at the bottom corner portion where inconsistency is most likely to occur, that is, where permanent strain or damage may be caused by a difference in contraction between the edge of the bottom plate 13 and the base of the side wall during a cooling down process, because of the corrugations 6' which are spaced at intervals in the circumferential direction and the upstanding corrugations 5' which continue from the corrugations 6' over the periphery of the bottom wall, large reaction forces cannot arise.

With regard to contraction in the radial direction of the corner portion, since the thermal strain of the bottom plate 13 is absorbed by the square-lattice pattern of the corrugated members (as will be described later) reaction forces resisting the thermal strain cannot arise.

As regards the bottom plate 13, since the corrugated members 7 are disposed on the bottom plate 13 in the aforementioned square-lattice pattern, longitudinal and lateral strains can be absorbed because the corrugations 7 in the lateral and longitudinal directions, respectively, are free to open because there is no anchoring of the bottom plate. Thus, inconsistencies cannot arise.

Figure 3:
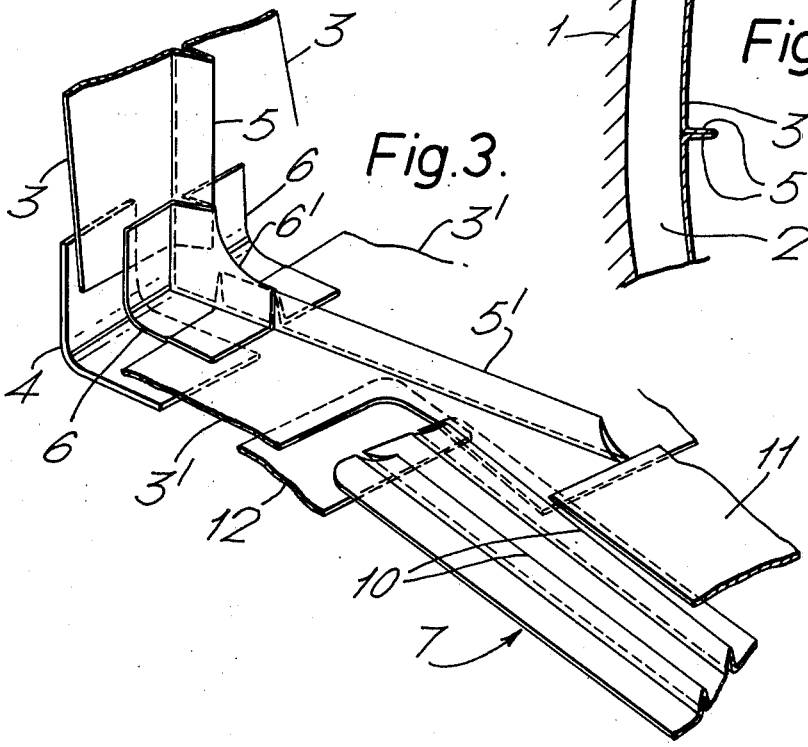
FIG. 3 is an isometric view of the bottom corner of the tank shown in FIG. 1 as viewed from an inner upward direction.
Figure 2:
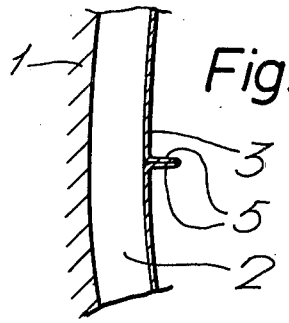
FIG. 2 is a cross-sectional view in the direction of the arrows II—II in FIG. 1.

In addition, since the junction between the side wall 3 and the bottom plate 13 is constructed, as shown in FIG. 3, by means of the corner members 6, the flanged radial gusset members 3', and the patches 12 which are all joined by linear welding in a single plane and which do not include a complex three-dimensional geometry, the junction can be simply effected in a liquid-tight manner, thus reducing to a minimum the possibility of leakage of the stored liquid.

While the thin plates 11 overlap on the upper surfaces of the respective adjacent flanges of the corrugated member 7 in the above-described embodiment, they could overlap on the lower surfaces of the flanges instead. Also, it is to be noted that where one end of each corrugated member 7 is jointed to the mid-point of another corrugated member 7, this may be effected either by butt-welding, or by lap-welding.

Furthermore, it is to be noted that the corrugations 5, 6' and 5' may be formed either by welding the top edges of adjacent flanges of two members, or by suitable bending of a single sheet.

It is to be noted that the corner members 6 may not always be necessary, if the bottom end of the side wall 3 is bent inwardly so as to serve also as the radial gusset member 3'. In addition, while the ends of the corrugated members 7 are cut in a polygonal shape rather than in a straight line in the preferred embodiment shown in FIG. 5, these end portions could also be cut linearly.

As described in detail above, in the membrane structure according to the present invention, the corrugated members of the bottom plate 13, which are assembled in a square-lattice pattern, can effectively absorb the thermal strains caused by the low temperature of the liquid to be stored. In addition, because the corner members provide a continuation of the corrugations of the side wall 3 into the bottom plate, the membrane structure according to the present invention has advantages in that, in contrast to the inner wall of the tank of the prior art, stress concentration is avoided. Hence, accidental leakage of stored liquid is unlikely to arise.

What we claim is:

1. A membrane structure for a liquified gas storage tank having side and bottom walls, said membrane structure comprising:

a side wall membrane surronding the inside of said side walls, said side wall membrane being expansible and contractible in response to thermal conditions; and a bottom wall membrane operatively connected to said side wall membrane and covering said bottom wall, said bottom wall membrane being expansible and contractible in response to thermal conditions and comprised of:

a plurality of spaced, parallel U-shaped corrugated sheet members arranged in a square-lattice pattern with the end of each U-shaped member connected to substantially the mid-point of another member extending normal thereto, each U-shaped member having a pair of vertical upwardly extending flanges of equal height and a pair of L-shaped sheet members adjacent said U-shaped member, one L-shaped member on either side of said U-shaped member, and each L-shaped member having its vertical portion upwardly extending and spaced from and parallel to one of said flanges, the top edges of said flanges and said L-shaped members being continuously welded together, and a thin plate sheet sealed between said corrugated members.

2. A membrane structure as claimed in claim 1, wherein:

said side wall membrane has a plurality of spaced vertical corrugations; and corner members having corrugations therein corresponding to said vertical corrugations said corners members connecting said side wall membrane and said bottom wall membrane.

3. A liquified gas storage tank comprising:

a rigid side wall;

a rigid bottom wall connected to the bottom of said side wall;

a thermal insulating material lining the inside of said side and bottom walls; and an expansible and contractible membrane lining on the outside of said insulating material, said membrane lining being comprised of:

a side wall membrane surrounding the inside of said side walls, said side wall membrane being expansible and contractible in response to thermal conditions, and a bottom wall membrane operatively connected to said side wall membrane and covering said bottom wall, said bottom wall membrane being expansible and contractible in response to thermal condition and comprised of a plurality of spaced, parallel U-shaped corrugated sheet members arranged in a square-lattice pattern with the end of each U-shaped member connected to substantially the mid-point of another member extending normal thereto, each U-shaped member being a pair of upwardly extending vertical flanges of equal height and a pair of L-shaped sheet members adjacent said U-shaped member, one L-shaped member on either side of said U-shaped member, and each L-shaped member having its vertical portion upwardly extending and spaced from and parallel to one of said flanges, the top edges of said flanges and said L-shaped members being continuously welded together, and a thin plate sheet sealed between said corrugated members.

* * * * *